US008579504B2

(12) United States Patent
Koeniger et al.

(10) Patent No.: US 8,579,504 B2
(45) Date of Patent: Nov. 12, 2013

(54) SUBSEA AND LANDING STRING DISTRIBUTED TEMPERATURE SENSOR SYSTEM

(75) Inventors: Christian Koeniger, Egelsbach (DE); Philip Smith, Southampton (GB); John A. Kerr, Sugar Land, TX (US)

(73) Assignee: Schlumberger Oilfield UK PLC, Sensor Highway Limited, Southampton (GB)

( * ) Notice: Subject to any disclaimer, the term of this patent is extended or adjusted under 35 U.S.C. 154(b) by 2182 days.

(21) Appl. No.: 10/520,960

(22) PCT Filed: Jul. 2, 2003

(86) PCT No.: PCT/GB03/02839
§ 371 (c)(1),
(2), (4) Date: Feb. 3, 2006

(87) PCT Pub. No.: WO2004/007910
PCT Pub. Date: Jan. 22, 2004

(65) Prior Publication Data
US 2006/0245469 A1 Nov. 2, 2006

(51) Int. Cl.
*G01K 13/00* (2006.01)
*G01K 3/00* (2006.01)
*G01K 11/00* (2006.01)
*G01J 5/00* (2006.01)

(52) U.S. Cl.
USPC ..... 374/136; 374/137; 374/143; 374/112; 374/161; 374/131

(58) Field of Classification Search
USPC ..... 374/136, 137, 161, 112, 131, 143
See application file for complete search history.

(56) References Cited

U.S. PATENT DOCUMENTS

| | | | | |
|---|---|---|---|---|
| 4,616,705 | A * | 10/1986 | Stegemeier et al. | 166/250.01 |
| 5,592,282 | A * | 1/1997 | Hartog | 356/44 |
| 5,992,250 | A | 11/1999 | Kluth | |
| 6,276,454 | B1 * | 8/2001 | Fontana et al. | 166/343 |
| 6,352,114 | B1 | 3/2002 | Toalson | |
| 6,527,052 | B2 * | 3/2003 | Ringgenberg et al. | 166/336 |
| 6,640,900 | B2 * | 11/2003 | Smith | 166/336 |
| 6,644,848 | B1 * | 11/2003 | Clayton et al. | 374/7 |
| 6,758,271 | B1 * | 7/2004 | Smith | 166/250.1 |
| 6,769,805 | B2 * | 8/2004 | Williams et al. | 374/137 |
| 6,994,162 | B2 * | 2/2006 | Robison | 166/250.01 |
| 7,055,604 | B2 * | 6/2006 | Jee et al. | 166/305.1 |
| 7,304,725 | B2 * | 12/2007 | Hartog et al. | 356/73.1 |

(Continued)

FOREIGN PATENT DOCUMENTS

| | | |
|---|---|---|
| GB | 2347448 A | 9/2000 |
| WO | 9964781 | 11/2009 |

*Primary Examiner* — Mirellys Jagan
(74) *Attorney, Agent, or Firm* — Brandon S. Clark

(57) ABSTRACT

A line is deployed along a landing string or along a marine riser of a subsea well. The line has sensors, such as temperature sensors, distributed along its length. In one embodiment, the line comprises a fiber optic line that includes fiber optic temperature sensors distributed along its length. In another embodiment, the line comprises a fiber optic line used to transmit light, wherein the returned back-scatter light is analyzed to provide a temperature profile along the length of the fiber line. The fiber optic line can be deployed by connecting it to the landing string, pumping it down a pre-existing conduit (such as a hydraulic or chemical injection conduit), or pumping it down a dedicated fiber optic specific conduit.

18 Claims, 7 Drawing Sheets

(56) References Cited

U.S. PATENT DOCUMENTS

| | | | | |
|---|---|---|---|---|
| 2001/0020675 | A1 | 9/2001 | Tubel et al. | |
| 2002/0014340 | A1 | 2/2002 | Johnson | |
| 2002/0162665 | A1* | 11/2002 | Adams et al. | 166/382 |
| 2002/0189806 | A1* | 12/2002 | Davidson et al. | 166/250.01 |
| 2003/0034177 | A1* | 2/2003 | Chitwood et al. | 175/61 |
| 2003/0047317 | A1* | 3/2003 | Powers | 166/373 |
| 2003/0056950 | A1* | 3/2003 | Burgess et al. | 166/250.01 |
| 2003/0075361 | A1* | 4/2003 | Terry et al. | 175/61 |
| 2003/0103551 | A1* | 6/2003 | Haddad et al. | 374/136 |
| 2004/0252748 | A1* | 12/2004 | Gleitman | 374/130 |
| 2005/0072565 | A1* | 4/2005 | Segura et al. | 166/100 |
| 2005/0211441 | A1* | 9/2005 | Vold et al. | 166/378 |
| 2006/0165344 | A1* | 7/2006 | Mendez et al. | 385/13 |
| 2007/0235223 | A1* | 10/2007 | Tarr et al. | 175/7 |

* cited by examiner

SUBSEA AND LANDING STRING DISTRIBUTED TEMPERATURE SENSOR SYSTEM

BACKGROUND

The invention generally relates to the monitoring of parameters, particularly but not exclusively temperature, in the subsea environment and along (either interior or exterior to) a relevant temporary landing string or riser assembly. The invention also relates to using a distributed temperature system to determine whether solids have formed in the surroundings of a pipeline or wellbore.

At various times during the life of a subsea well, a temporary marine riser is located between a blow out preventer (BOP) and a platform at the ocean surface. The BOP is located at the ocean bottom. In instances when a vertical Christmas tree will be used, a BOP is installed for the drilling and completion stages of the well. Thereafter, the BOP is removed and the vertical Christmas tree is installed, until intervention of the well is required at which time the vertical tree is removed and the BOP is reinstalled. In instances when a horizontal Christmas tree will be used, a BOP is installed for the drilling stage of the well. Thereafter, the BOP is removed and the horizontal Christmas tree is installed with the BOP on top of it. The well is then completed and tested with the BOP installed on top of the horizontal tree. Further intervention is also conducted through the BOP on top of the horizontal tree. In any of the cases when the well is being drilled, completed, or tested, a temporary landing string may be deployed within the marine riser and within the BOP.

It is important to control and monitor temperature at the BOP as well as along the marine riser. Unacceptably high temperatures could compromise the safety systems of the BOP or landing string. Unacceptably low temperatures could provide an indication of hydrate formation or increased likelihood of wax deposition. Prior art systems used to obtain this information involve running separate pods and electrical lines to obtain a single point of measurement. These prior art techniques are not capable of providing temperature measurements at multiple points along the BOP and/or marine riser.

For example, when produced, hydrocarbons tend to have a high temperature. On the other hand, the marine riser, since it is surrounded by ocean water, tends to have a low temperature. Due to this temperature difference as well as the presence of other variables, hydrates, or other solids, sometimes form within the marine riser. The formation of hydrates in the marine riser in turn may cause blockage of flow and hold-up of intervention equipment, which could lead to a significant loss of money and time and may compromise safety systems. The ability to monitor the temperature at various points along the marine riser would provide an operator the ability to predict and avoid, through appropriate chemical injection for example, the formation of hydrates within the marine riser. Moreover, the ability to monitor temperature at various points along the marine riser would also provide an operator the ability to determine the position and extent of any hydrate blockage, which would enable the operator to educatedly establish a course of action.

Solids, such as waxes or hydrates, may also form in other pipelines, including subsea and industrial process pipelines, or in land wells. The ability to monitor temperature at various points along these structures would provide an operator the ability to determine the position and extent of any solid blockage, which would enable the operator to take corrective action.

Thus, there exists a continuing need for an arrangement and/or technique that addresses one or more of the problems that are stated above.

SUMMARY

In an embodiment of the invention, a system for measuring a parameter in a subsea well includes a riser extending from a platform adjacent the ocean surface towards the ocean bottom; a landing string extending within the riser from the platform towards the ocean bottom; and a line extending along at least part of the length of the landing string and including a distributed sensor system for sensing the parameter at various points along the length of the landing string.

According to another embodiment of the invention, a technique for measuring a parameter in a tubing includes: deploying a fiber optic line along at least part of the length of the tubing, the line comprising a part of a distributed temperature sensor system for sensing the temperature at various points along the length of the tubing; measuring the temperature at the various measurement points along the length of the tubing; and determining the presence of solids near the tubing by analyzing the temperature measurements.

Advantages and other features of the invention will become apparent from the following description, drawing and claims.

DETAILED DESCRIPTION

Figure 1:
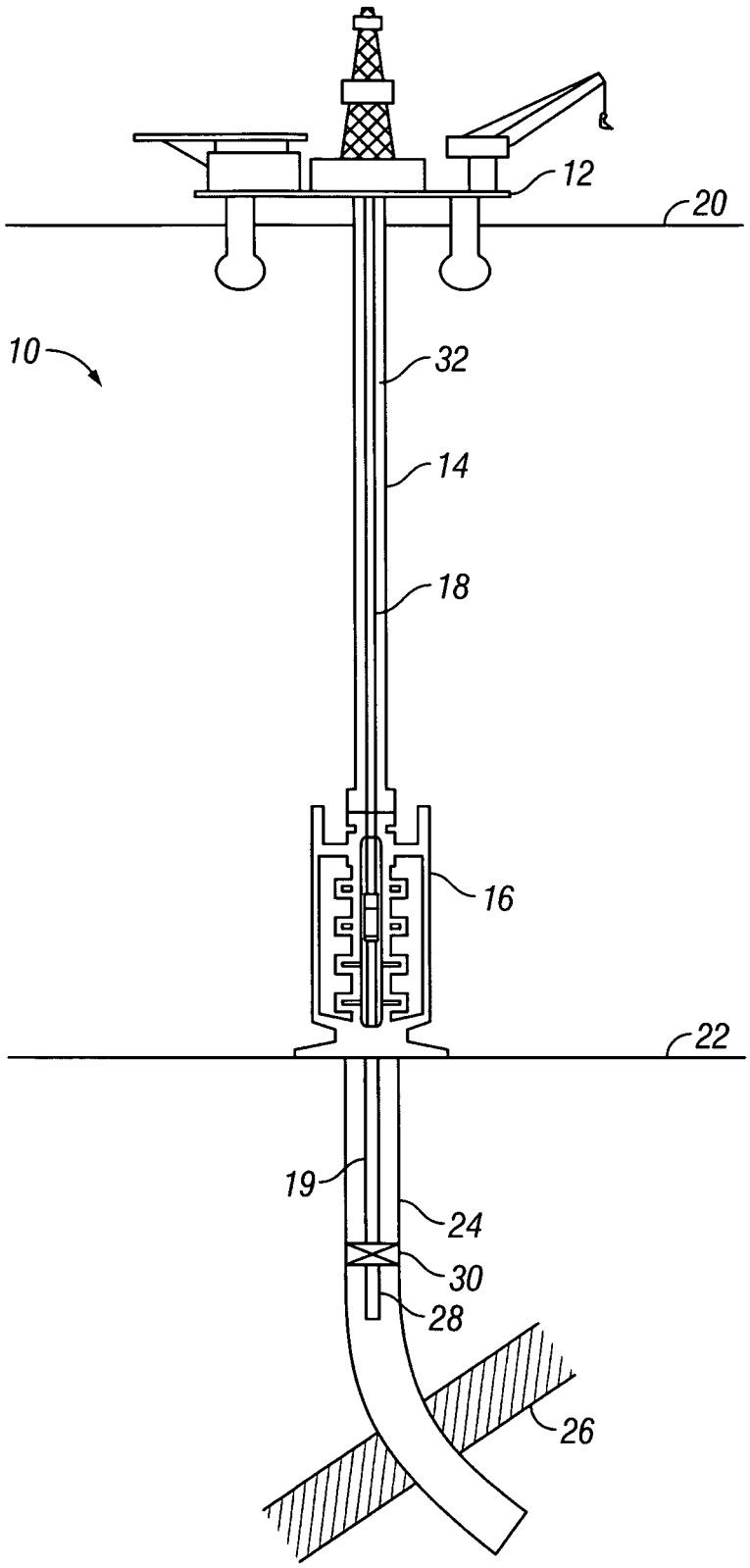
FIG. 1 is a schematic of a subsea well according to an embodiment of the invention.
Figure 5:
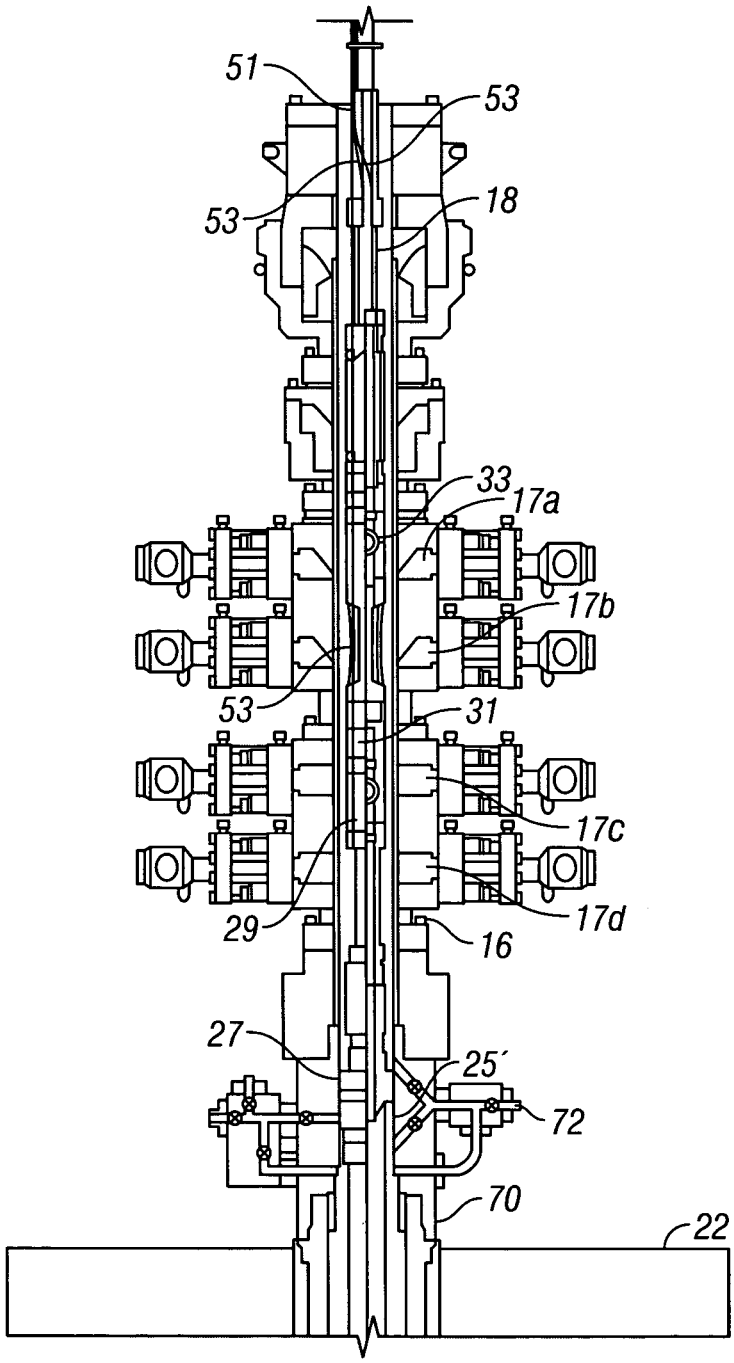
FIG. 5 is an elevational view showing the use and deployment of an embodiment of the invention within and through a horizontal Christmas tree.

FIG. 1 shows the case of a subsea well 10 that will include a vertical Christmas tree, and FIG. 5 shows the case of a subsea well that includes a horizontal tree. The use of a BOP in relation to a vertical or horizontal Christmas tree was previously generally described herein. For purposes of clarity, blow out preventers and Christmas trees will generally be referred to as "pressure control equipment." Whether a vertical or horizontal Christmas tree is used is not of primary concern for this invention.

Turning to FIG. 1, the subsea well 10 includes a platform 12, a marine riser 14, a blow out preventer (BOP) 16, and a landing string 18. The platform 12, which can be a floating platform or vessel, is typically located on the ocean surface 20, and the BOP 16 is located on the ocean floor 22. The marine riser 14 extends from the platform 12 to the BOP 16. The landing string 18 extends within the marine riser 14 from the platform 12 to the BOP 16. The wellbore 24, which is in fluid communication with the interior of the BOP 16, intersects a formation 26. Wellbore 24 may be cased or uncased. A major string 19 may be attached to the landing string 18 and may extend below the BOP 16 and into the wellbore 24.

When landing string 18 is utilized to test formation 26 and the major string 19 extends below the wellhead, the major string 19 may include a packer 30 that is selectively sealable against the wellbore 24 wall and that is located above an inlet section 28. Inlet section 28 provides fluid communication between the formation 26 and the interior of the landing string 18. When an operator is ready to test wellbore 24, hydrocarbons are induced to flow from the formation 26, into the wellbore 24 (through perforations in the casing if the wellbore 24 is cased), through the inlet section 28, through the BOP 16, and up to the platform 12 through the landing string 18.

Figure 9:
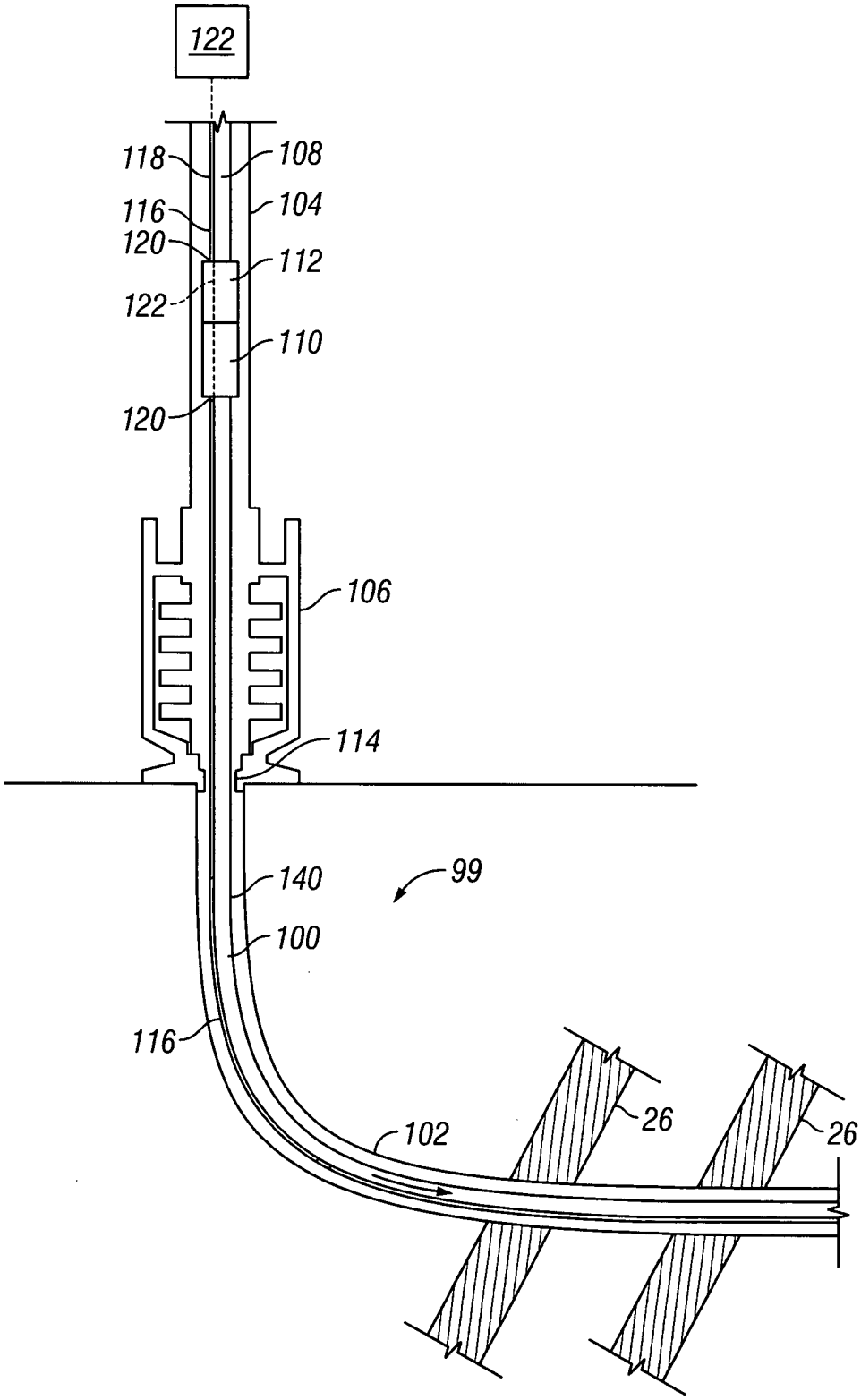
FIG. 9 shows the line deployed with a permanent completion.

The use of landing string 18 and major string 19 in order to facilitate testing formation 26 is described for exemplary purposes only. As previously disclosed, other configurations of landing string 18 may be used for drilling wellbore 24, completing the wellbore (as shown in FIG. 9), and other workover operations. In the testing configuration, the components for landing string 18 would change depending on its use. The landing string 18 area proximate the BOP 16 as well as any associated equipment is commonly referred to as the "subsea test tree."

Figure 2:
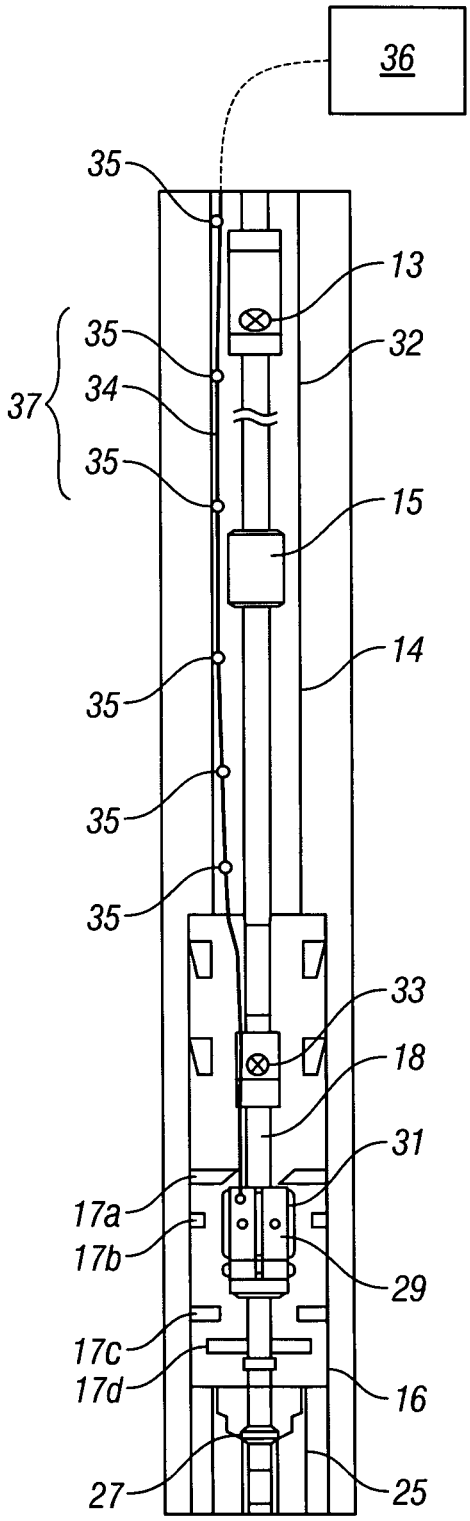
FIG. 2 is an elevational view of the connection between the landing string and the tubing hanger assembly, with the landing string having a line that includes a distributed sensor system.

FIG. 2 is a detailed view of the landing string 18 and BOP 16. The landing string 18 is landed on a hanger or upper casing hanger, generically described as hanger 25, located at the bottom of the wellhead. The landing profile 27 on landing string 18 is at least partially supported by hanger 25. BOP 16 includes a plurality of ram sets 17 that are extendable from a retracted position that enables the passage of the landing string 18 to an extended position that engages (and depending on the ram set seals) against the landing string 18. For instance, ram sets 17*a*, 17*b*, and 17*c* are shown in their retracted position, whereas ram set 17*d* is shown in its extended position.

Above the BOP 16, landing string 18 may include at least one and typically two barrier valves 13, such as ball, flapper, or disc valves. Moreover, above the BOP 16, landing string 18 may also include additional equipment 15, as necessary to complete the objective of the drilling, testing, completion, or workover operation. Such equipment may include additional packers, telemetry or control modules, motors, pumps, or valves to name a few.

Within the BOP 16, landing string 18 may also include at least one and typically two barrier valves 29, such as ball, flapper, or disc valves, which provide additional necessary safety mechanisms for well shut-in and control. Within the BOP 16, landing string 18 may also include an unlatching mechanism 31 and a retainer valve 33. Unlatching mechanism 31 separates the section of the landing string 18 therebelow from the section of the landing string 18 thereabove to allow string disconnect and removal or displacement of the platform from above the BOP and wellhead. Retention valve 33 is a valve which, if the landing string 18 is separated as described in the previous sentence, prevents any fluid located in the section of the landing string 18 above retention valve 33 from venting into the ocean or marine riser 14.

Figure 8:
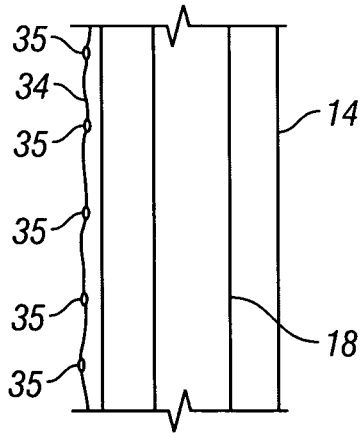
FIG. 8 shows the line deployed exterior to the marine riser.

As can be seen in FIG. 2, a line 34 can be deployed in the riser annulus 32 between the landing string 18 and the marine riser 14. In another embodiment as shown in FIG. 8, the line 34 can be deployed exterior or interior and attached to the marine riser 14. The line 34 includes a distributed sensor system 37. The distributed sensor system 37 includes measurement points 35 distributed along its length, each measurement point measuring a parameter such as temperature, pressure, strain, acoustic vibrations, or chemical species. It is understood that reference number 35 is shown only for purposes of illustration and exemplary location. The measurement points 35 may be dispersed along line 34 as required by the user to provide the desired resolution.

Line 34 may be attached to equipment 36, which equipment receives, analyzes, and interprets the readings received from the measurement points 35. Equipment 36 may be located at the ocean surface 20 or at the ocean floor 22, among other places.

In one embodiment, line 34 is a fiber optic line, and the surface equipment 36 comprises a light source and a computer or logic device for obtaining, interpreting, and analyzing the readings. The equipment 36 and fiber optic line 34 in one embodiment may be configured to measure temperature along the line 34 (such as at each point 35). Generally, in one embodiment, pulses of light at a fixed wavelength are transmitted from the light source in surface equipment 36 down the fiber optic line 34. At every measurement point 35 in the line 34, light is back-scattered and returns to the surface equipment 36. Knowing the speed of light and the moment of arrival of the return signal enables its point of origin along the fiber line 34 to be determined. Temperature stimulates the energy levels of the silica molecules in the fiber line 34. The back-scattered light contains upshifted and downshifted wavebands (such as the Stokes Raman and Anti-Stokes Raman portions of the back-scattered spectrum) which can be analyzed to determine the temperature at origin. In this way the temperature of each of the responding measurement points 35 in the fiber line 34 can be calculated by the equipment 36, providing a complete temperature profile along the length of the fiber line 34. It is understood that in this embodiment the measurement points are not discrete points and can be infinitely close to each other. In this embodiment, back-scattered light is received from the entire length of the fiber line 34 and are then resolved by the surface equipment 36 to provide a full temperature profile along the line 34. This general fiber optic distributed temperature system and technique is known in the prior art. As further known in the art, it should be noted that the fiber optic line 34 may also have a surface return line so that the entire line has a U-shape. One of the benefits of the return line is that it may provide enhanced performance and increased spatial resolution to the temperature sensor system.

In another embodiment, distributed sensor system 37 may include a fiber optic sensor located at each measurement point 35 along the line 24. For instance, each fiber optic sensor may comprise a brag grating temperature sensor that reflects light back to the equipment 36. As is known in the art, the light reflected by the brag grating temperature sensors 35 can be dependent on the temperature of the environment. Thus, the equipment 36 analyzes this dependency and calculates the temperature at the particular sensor 35. Other types of fiber optic sensors that can be distributed along a fiber optic line 34 may also be used.

In another embodiment, the line 34 is an electrically conductive line, and the sensors are electrically powered. Equipment 36, for an electrically conductive line 34, may comprise a power source and a computer for reading the measurements. In yet another embodiment, the line 34 is a hybrid fiber optic and electrically conductive line, wherein the optical fiber may be disposed within the electrically conductive line.

Figure 3:
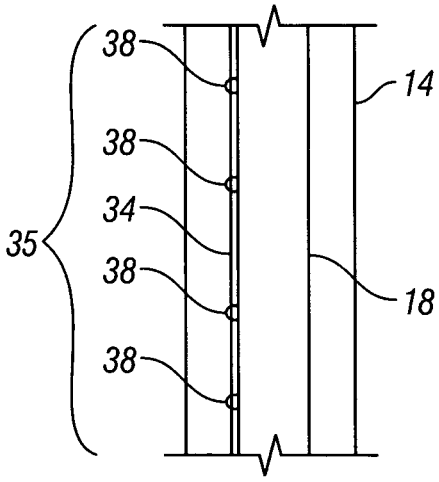
FIG. 3 is one technique used to deploy the distributed sensor system.

Installation of line 34 can be performed using a variety of techniques and methods. As shown in FIG. 3, the line 34 can be mechanically attached, such as by fasteners 38, to the landing string 18 and thereby deployed along with the landing string 18. This installation technique may also be used in the embodiment shown in FIG. 8 with the fasteners attaching the line 34 to the exterior of the marine riser 14. The line 34 may also be attached to the interior of the marine riser 14.

Figure 4:
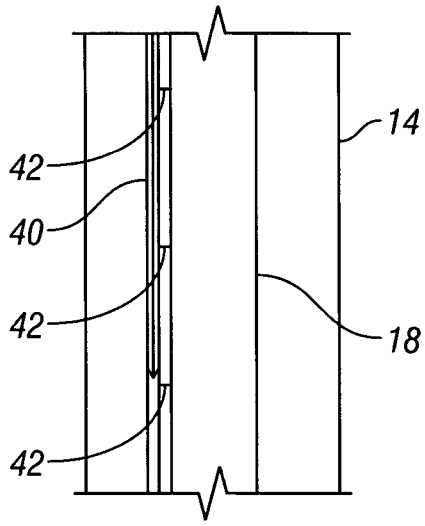
FIG. 4 is another technique used to deploy the distributed sensor system.

Another deployment technique which is particularly useful for a fiber optic line 34 is to pump the fiber optic line 34 down a conduit, such as conduit 40 shown in FIG. 4. This technique is described in U.S. Reissue Pat. No. 37,283. Essentially, the fiber optic line 34 is dragged along the conduit 40 by the injection of a fluid at the surface. The fluid and induced injection pressure work to drag the fiber optic line 34 along the conduit 40. It is noted that although the conduit 40 is shown mechanically attached to the landing string 18 by way of fasteners 42, the conduit 40 may instead be attached to the interior of the landing string 18 or to the exterior or interior of riser 14. This pumping technique may also be used in configurations where a surface return line provides the U-shape previously discussed. This installation technique may also be used in the embodiment shown in FIG. 8 wherein the conduit 40 would be attached to the exterior of the marine riser 14.

In one embodiment, conduit 40 may comprise a conduit that is deployed specifically for use as a fiber optic deployment conduit. In another embodiment, conduit 40 may comprise a conduit already existing on the landing string 18, such as a hydraulic conduit utilized to control other equipment or a chemical injection line used to inject chemicals into desired locations at desired times. Both hydraulic conduits and chemical injection lines can be found within control umbilicals. FIG. 5 shows a landing string 18 having a control line umbilical 51 that includes a plurality of control lines 53, such as hydraulic conduits and chemical injection lines. Fiber optic line 34 may be deployed through any of the control lines 53 by use of the fluid drag technique previously described.

In one embodiment, line 34 is pumped into conduit 40 prior to deployment of the landing string 18 and the conduit 40 is then attached (with line 34 therein) to the landing string 18. In another embodiment, the line 34 is also located within a conduit 40 that is attached to either the landing string 18 or riser 40, but the line 34 is manually inserted within the conduit 40 as the landing string 18 is deployed.

Figure 6:
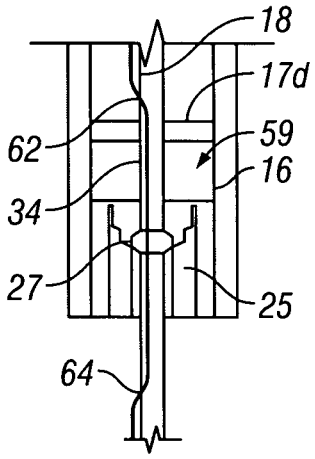
FIG. 6 shows a schematic of a technique used to enable the deployment of the distributed sensor system past the landing shoulder of a wellhead.
Figure 7:
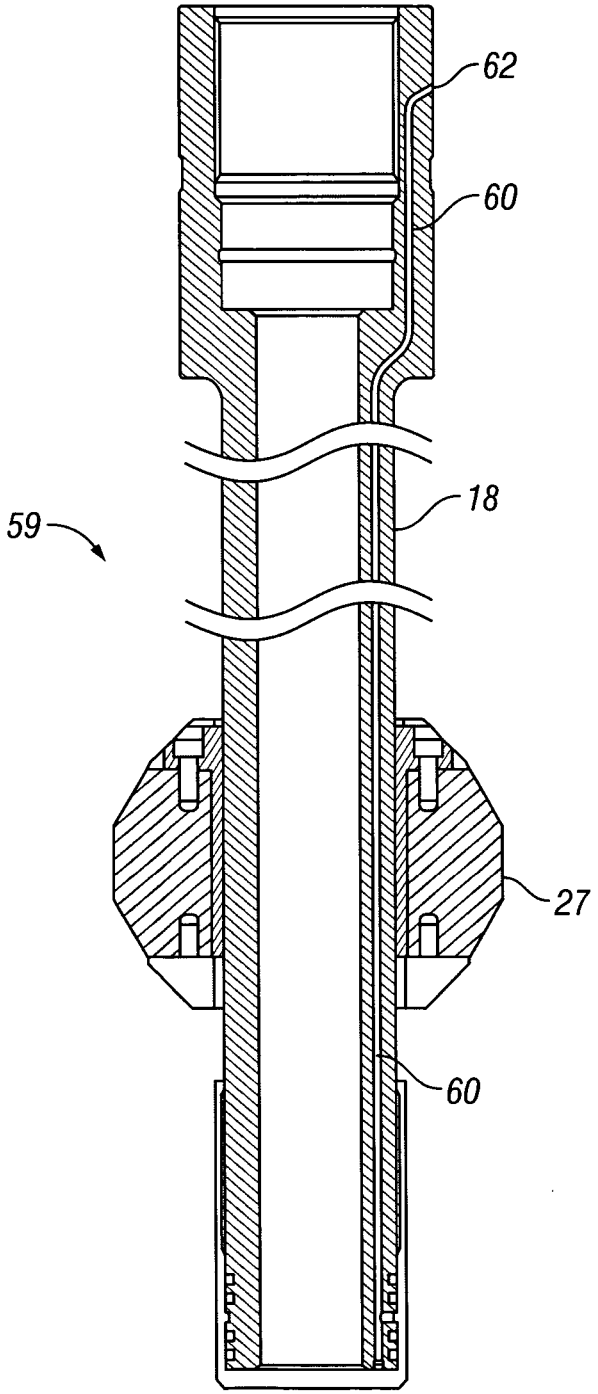
FIG. 7 shows the part of the landing string that enables the deployment of the distributed sensor system past the landing shoulder of a wellhead.

In one embodiment as shown in FIG. 2, the line 34 extends to the BOP 16 and then either terminates or returns to the surface (U-shape) prior to the hanger 25. In another embodiment as illustrated in FIGS. 6-7, the line 34 is continued through the BOP 16 below the hanger 25 and down to a selected point on the major string 19 located within wellbore 24 (the line 34 may return to the surface in the U-shape from this point as well). Obtaining measurement points below the hanger 25 can be beneficial for the reasons previously indicated in relation to measurement points above the hanger. As subsea wells become more prevalent and deeper, operators will desire as much information as possible from these high value and risk investments. Presently, subsea wells have less productivity than comparable land wells primarily due to the relative lack of data available on the subsea wells.

Line 34 can be extended below the hanger 25 and across rams 17 by passing the line 34 through a passageway located within the landing string 18/major string 19, as generally shown in FIG. 6. Thus, since the line 34 passes within the landing string 18 at the general location where the landing string 18 is landed on the hanger 25 (and is proximate the rams 17), the connection between the landing string 18 and the hanger 25 or rams 17 does not affect the line 34 or its performance. FIG. 7 illustrates a part 59 of the landing string 18 that can be used to extend the line 34 below the hanger 25 and past the rams 17 in this manner. FIG. 7 shows the part 59 of the landing string 18 that includes landing profile 27. Part 59 also includes a passageway 60. Passageway has a port 62 above the landing profile 27 providing fluid communication to the exterior of the landing string 18 and a port 64 (not shown in FIG. 7 but similar to port 62) below the landing profile 27 providing fluid communication to the exterior of major string 19. The line 34 can be extended through passageway 60 from port 62 to and through port 64 without being harmed or affected by the connection between hanger 25 or rams 17 and landing string 18. Use of pressure fittings at the ports may be required. Thus, the same line 34 can be used to measure the temperature above and below the ocean floor 22. It is noted that the deployment technique with conduit 40 (utilizing fluid drag) can also be used when the line 34 extends below the hanger 25 by aligning the conduit 40 with port 62 and, if desired, by adding a similar conduit from port 64 to the desired location.

Although part 59 is shown as being constructed from an integral piece, part 59 can be constructed from a plurality of sections having aligned passageways enabling the passage of line 34 past the hanger 25. It is further noted that pieces similar to part 59 (that include passageways 60) with appropriate fluid communication and porting, may have to be used above hanger 25 in order to pass the line 34 past any contracted rams 17*a*-17*d*. Similar porting may also have to be used in tools 29, 31, and 33.

Turning to FIG. 5, the subsea well 10 shown therein includes a horizontal Christmas tree 70. As previously disclosed, BOP 16 is typically removably attached to the top of the horizontal Christmas tree 70. Like numerals between the FIGS. 1 and 5 represent like parts. All aspects of the present invention may be used in and deployed through a horizontal Christmas tree 70. The main difference between the deployment of FIG. 1 and that of FIG. 5 is that if a horizontal Christmas tree 70 is used, the landing profile 27 of the landing string 18 lands on the tubing hanger 25' of the tree 70. Once an operator is prepared, production may be continued or commenced through the flow lines 72 of the horizontal tree 70. For purposes of clarity, the hanger 25 and the tubing hanger 25' will generally be referred to as a "landing shoulder."

With the line 34 configured and deployed as previously described, the distributed sensor system 37 and surface equipment 36 are utilized to provide measurements, such as for temperature, at the various measurement points 35 along the landing string 18, which measurement points 35 may also be extended below the ocean floor 22 and past the landing shoulder if the line extension as discussed above is also used. With these measurements, an operator is able to determine whether the temperature within the BOP 16 and the marine riser 14 is outside the acceptable range. Moreover, these temperature measurements enable an operator to predict and model hydrate formation and other chemical depositions (wax, scale, etc.) (hereinafter referred to as "solids") and thus take measures to prevent these formations, such as by the appropriate chemical injection. With the temperature measurements at the BOP, an operator also knows the temperature of the effluents flowing out of the well which enables the operator to purchase the appropriate wellhead and subsea equipment for production, including procuring and specifying rams that are designed to provide a seal at high temperatures and pipeline systems that provide the required degree of thermal insulation. In addition, any permanent riser or production umbilical installed for the production phase must be rated to ensure structural integrity in the face of the currents, which can sway or vibrate or move such equipment. The temperature measurements provided by this invention can provide qualitative information on ocean currents that are a critical consideration in production and drilling riser design.

Embodiments of the invention as disclosed may also be used to monitor the presence and removal of solids once they are formed in either the marine riser 14 or within the wellbore 24. As is known, solids have a temperature that is substantially lower than the temperature of the flowing hydrocarbons. This temperature difference, and thus the formed solids, can easily be located and sensed by the distributed sensor system 37. This information, particularly the location, extent, and length of the blockage, enables an operator to choose the appropriate treatment method. During treatment, the same distributed sensor system 37 provides the ability to monitor the effect of the chosen treatment method. The monitoring of the presence and removal of hydrates can be conducted whether or not the particular landing string involved already includes an installed line 34. If the relevant landing string already does have an installed line, then the same line can be used to provide the monitoring. If the relevant landing string does not already have an installed line, then a line 34 can be deployed through one of the control lines 53 of the control line umbilical 51 (such as by use of the fluid drag method previously discussed).

In any of the embodiments previously described, line 34 may also be used as a communications line between the surface and the subsea environment. For instance, line 34 may be operatively linked to a valve, such as a barrier valve 13, a barrier valve 29, or a retainer valve 33, to communicate the position of such valve to the surface. Line 34 may also communicate the status of or information/data from other components, such as packers, perforating guns, or sensors, even if such components are located within wellbore 24. Moreover, a command may be sent through the communications line in order to trigger the activation of one of the downhole components.

Much of the disclosure thus far has dealt with the exploration and appraisal phases of a subsea well. However, this invention may also be used in conjunction with a subsea well permanent completion, including during its installation. In FIG. 9, a permanent completion 100 is shown being deployed in subsea well 99. As in the prior figures and disclosure, the permanent completion 100 is deployed in a wellbore 102 and through a marine riser 104 and BOP 106. The permanent completion 100 is suspended from a landing string 108. A tubing hanger 110 and tubing hanger running tool 112 are disposed between the landing string 104 and permanent completion 100. When the permanent completion 100 is fully deployed within the wellbore 102, tubing hanger 110 hangs from wellhead 114 and suspends the tubing hanger 110 therefrom. As is known, once the operator is ready, the tubing hanger running tool 112 is disconnected and the landing string 108 and tubing hanger running tool 112 are retrieved.

Also as in the prior figures and disclosures, a line 116 (like line 34) can be deployed alongside the landing string 108 and permanent completion 100. The line 116 may be deployed within a conduit 118, such as manually or by fluid drag, as previously disclosed. The tubing hanger 110 and tubing hanger running tool 112 have ports 120 and passageways 122 to allow the passage of the line 116 therethrough, specially when the tubing hanger 110 is landed on the wellhead 114. The ports 120 and passageways 122 are similar to the ports 62 and passages 60 of FIG. 7 and for fiber optic lines may include optical wet connects in order to provide optical communication therethrough (in which case the line 116 may not be able to be pumped in by fluid drag). When the line 116 is deployed alongside the permanent completion 100, the line 116 is typically meant to be permanently installed in the wellbore 102 with the permanent completion 100.

As the permanent completion 100 is deployed through the marine riser 104 and BOP 106 and then into the wellbore 102, there is a risk that the line 116 and conduit 118 will be damaged thus compromising the functionality thereof. This risk is specially high in horizontal wells. In order to monitor this potential damage, the line 116 is attached to equipment 122 during the deployment of the landing string 108 and permanent completion 100. The equipment receives, analyzes, and interprets the readings received from the measurement points along the line 116. As long as the equipment 122 continues receiving data from all of the measurement points along the line 116 or as long as such data is within an expected and/or acceptable range, an operator can be more certain that the line 116 and conduit 118 have not been damaged. However, if the equipment 122 stops receiving data from at least one of the measurement points or the data received is not within the expected and/or acceptable range, this may indicate that the line 116 and conduit 118 have been damaged. Since the operator will be able to determine whether damage has occurred during the deployment, the operator will have the choice of stopping deployment operation and retrieving the landing string 108 and permanent completion 100 to fix the damage. Otherwise, the operator would have to wait until the permanent completion 100 is fully deployed and installed in the wellbore 102 to determine if there is damage, at which time retrieval and repair are much more costly.

Thus, in accordance with various embodiments of the invention, a temperature measurement line (such as the line 34 or the line 116, as examples) may be deployed along the length of a subsea tubing for purposes of performing various types of measurements along the tubing. These measurements include temperature measurements and measurements to predict and clean-up solids along tubing, whether the hydrates are located inside or outside of the tubing. The embodiments described above depict the tubing as being a landing string or a marine riser or even a wellbore. However, in other embodiments of the invention, a line, such as the line 34 or 116 may be used for purposes of measuring temperature, predicting hydrate build-up, monitoring solid clean-up, etc., in other types of tubing, including pipelines, such as industrial and subsea pipelines.

For example, as depicted in FIG. 9, the completion 100 may include a production tubing 140 that extends through formations 26 (once fully deployed). The line 116 may extend through the formations along the length of the production tubing 140 for purposes of providing temperature measurements that may be used for one of the purposes set forth above. The line 116 may be located inside a conduit that extends along the production tubing 140, may be installed with the production tubing 140, may be pumped downhole after the production tubing 140, etc., as discussed in the other embodiments described herein. Thus, the presence of and the clean-up of solids along the production tubing 140 may be monitored at the surface of the well via the line 116 that extends along the production tubing 140.

In accordance with other embodiments of the invention, a line similar to either line line 34 or 116 may be deployed along subsea tubing or pipelines other than a production tubing, a marine riser or a landing string. For example, FIG.

10 depicts a subsea oil well field 200 that is located on a sea floor 201. This field 200 includes various subsea wells as depicted by the subsea trees 202 of these wells. The field 200 includes various tubings for purposes of communicating fluids from the various subsea wells. For example, each tree 202 may communicate produced fluid via a tubing 210 to a distribution manifold 220 shared by the subsea wells. The distribution manifold 220, in turn, may be coupled to a subsea pipeline 230 that may extend to another distribution manifold or to a surface platform, as just a few examples.

During the production of fluid from the various wells, solids may accumulate in one or more of these above-described tubings. For purposes of identifying conditions favorable to solid formation as well as identifying particular substances (such as hydrates) inside or outside of these tubings, in some embodiments of the invention, the subsea well 200 includes measurement lines 34 in the various tubings.

Figure 10:
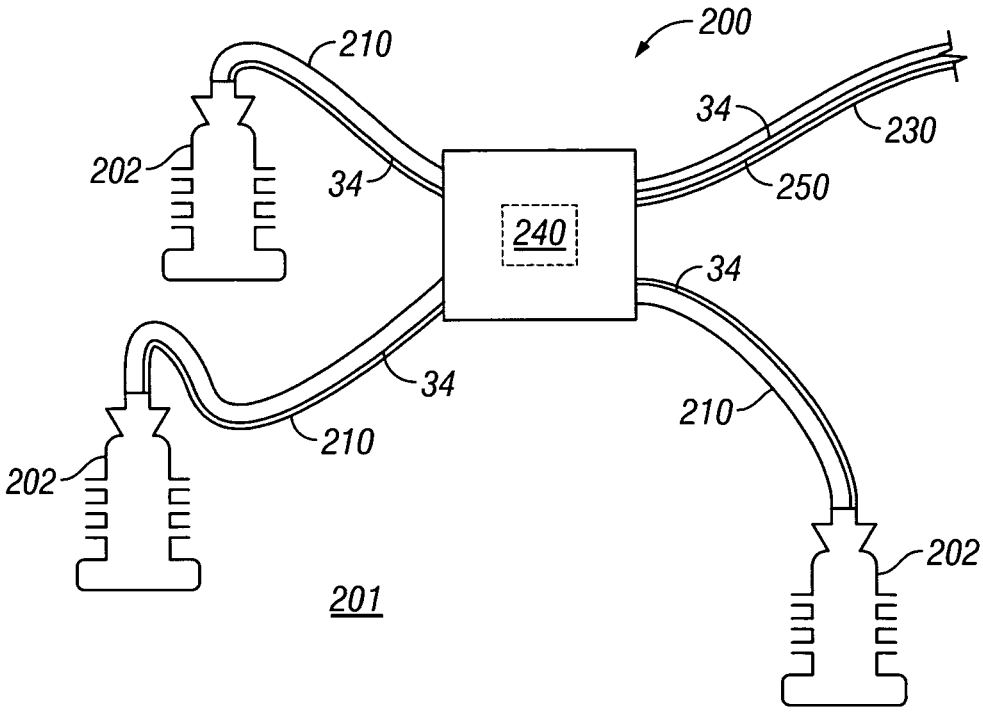
FIG. 10 is a schematic diagram of a subsea well field according to an embodiment of the invention.

As depicted in FIG. 10, in some embodiments of the invention, one or more of the tubings 210 may include the line 34 that extends from the well tree 202 to the distribution manifold 220. Thus, due to this arrangement, optical and electronic circuitry 240 in the distribution manifold 220 may use the line 34 in each tubing 210 to collect temperature measurements along the length of the tubing 210. These measurements may indicate the temperature inside and/or outside of the tubing 210, depending on the particular embodiment of the invention. In some embodiments of the invention, the apparatus 240 communicates this information to a surface platform, for example, using either a separate communication line 250 or possibly the line 34 that is located in the pipeline 230. Furthermore, the apparatus 240 may use the line 34 in the pipeline 230 for purposes of measuring temperature along points inside the pipeline 230. Other variations are possible.

Figure 11:
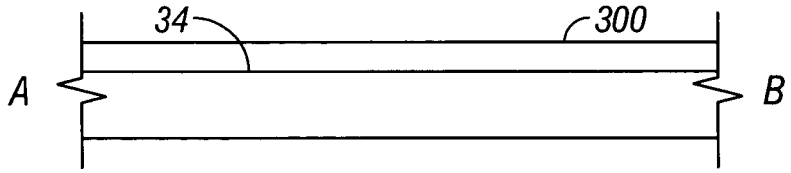
FIG. 11 is a schematic diagram of an industrial pipeline according to an embodiment of the invention.

As also shown in FIG. 11, in some embodiments of the invention, the temperature measurement line 34 may be deployed along an industrial pipeline 300 (also generally referred to as "tubing"). The industrial pipeline 300 may be transporting fluids at long lengths or it may be transporting fluids between discrete points A and B in an industrial plant or process. In any case, the line 34 may be used to monitor the presence and clean-up of solids accumulating in the pipeline 300 by monitoring the temperature.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A system usable with a subsea well, comprising:
- a riser extending from a platform adjacent an ocean surface towards an ocean bottom;
- a landing string extending within the riser from the platform towards the ocean bottom; and
- a line extending along at least part of a length of the landing string and including a distributed sensor system,
- wherein the landing string extends in an interval within the riser from the platform toward the ocean bottom, the distributed sensor system is adapted to sense a parameter at various points along the interval, the landing string extends at least partially within a pressure control equipment at the ocean bottom, and the line extends at least partially within the pressure control equipment.

2. The system of claim 1, wherein the line is mechanically attached to the landing string.

3. The system of claim 1, wherein the landing string is in communication with a well formation.

4. The system of claim 1, wherein the line is attached to the riser.

5. The system of claim 1, wherein the parameter measured is temperature.

6. The system of claim 5, wherein the distributed sensor system comprises a plurality of sensors distributed along the length of the line.

7. The system of claim 1, wherein the line comprises a fiber optic line.

8. The system of claim 7, further comprising:
- a conduit located proximate the landing string; and
- the fiber optic line located within the conduit.

9. The system of claim 8, wherein the conduit is within a control umbilical deployed as part of the landing string.

10. A system usable with a subsea well, comprising:
- a riser extending from a platform adjacent an ocean surface towards an ocean bottom;
- a landing string extending within the riser from the platform towards the ocean bottom; and
- a line extending along at least part of a length of the landing string and including a distributed sensor system,
- wherein the landing string extends in an interval within the riser from the platform toward the ocean bottom, the distributed sensor system is adapted to sense a parameter at various points along the interval, the landing string is landed on a landing shoulder located on a pressure control equipment, and the line extends below the landing shoulder.

11. The system of claim 10, wherein:
- the landing string includes a passageway having a port above the landing shoulder and a port below the landing shoulder, each port providing communication to the exterior of the landing string; and
- the line is extended below the landing shoulder by passing the line through the passageway and the ports past the landing shoulder.

12. The system of claim 11, wherein:
- the line is a fiber optic line;
- a conduit is located proximate the landing string and is aligned with the passageway port located above the landing shoulder; and
- the fiber optic line is located within the conduit and is extended below the landing shoulder by passing the line through the passageway and the ports past the landing shoulder.

13. The system of claim 12, wherein the fiber optic line is deployed by pumping the fiber optic line through the conduit and passageway.

14. The system of claim 13, wherein:
- a second conduit is aligned with the passageway port located below the landing shoulder;
- the fiber optic line is located within the conduit, is extended below the landing shoulder by passing the line through the passageway and the ports past the landing shoulder, and extends within the second conduit; and
- the fiber optic line is deployed by pumping the fiber optic line through the conduit, passageway, and second conduit.

15. A method usable with a subsea well, comprising:
- deploying a landing string within a riser, the landing string and riser extending from a platform on an ocean surface towards an ocean bottom;
- deploying a line along at least part of a length of the landing string, the line including a distributed sensor system; and
- measuring the parameter at the various measurement points along the length of the landing string, wherein the act of deploying the line along at least part of a length of the landing string comprises deploying the line along an interval of the landing string extending above the ocean bottom such that the distributed sensor system is adapted to sense a parameter at various points above the ocean bottom, the deploying the landing string step comprises landing out the landing string at a landing shoulder located on a pressure control equipment, and the deploying the line step comprises extending the line below the landing shoulder.

16. The method of claim 15, wherein the landing string is in communication with a well formation.

17. The method of claim 15, wherein the measuring step comprises measuring temperature at the various measurement points along the length of the landing string.

18. The method of claim 17, wherein the line comprises a fiber optic line and the measuring step comprises transmitting light through the fiber optic line and analyzing the returned back-scattered light to provide a complete temperature profile along the length of the fiber line.

* * * * *